US005509195A

United States Patent [19]

Watanabe

[11] Patent Number: 5,509,195

[45] Date of Patent: Apr. 23, 1996

[54] APPARATUS FOR CHANGING INTERVALS AT WHICH SELECTED WIRES ARE ARRANGED IN A LATERAL ARRANGEMENT OF WIRES

[75] Inventor: Souichi Watanabe, Yokohama, Japan

[73] Assignee: Molex Incorporated, Lisle, Ill.

[21] Appl. No.: 342,075

[22] Filed: Nov. 18, 1994

[30] Foreign Application Priority Data

Dec. 29, 1993 [JP] Japan ..... 5-350702

[51] Int. Cl.[6] ..... H01R 43/28; B21F 21/00

[52] U.S. Cl. ..... 29/755; 29/33 F; 29/33 M

[58] Field of Search ..... 29/35 F, 33 M, 29/755, 757, 759, 749, 34 D; 140/92.1, 93 R, 105, 147

[56] References Cited

U.S. PATENT DOCUMENTS

| | | | |
|---|---|---|---|
| 3,936,933 | 2/1976 | Folk et al. | 29/755 |
| 4,253,222 | 3/1981 | Brown et al. | 29/755 X |
| 4,493,147 | 1/1985 | Bakermans | 29/748 X |
| 4,572,248 | 2/1986 | Pegram et al. | 140/92.1 |
| 4,577,403 | 3/1986 | Garner | 29/33 F X |
| 4,614,028 | 9/1986 | Rich | 29/755 X |
| 5,033,186 | 7/1991 | Gaskell | 39/749 |
| 5,353,497 | 10/1994 | Hecker | 29/33 M X |

FOREIGN PATENT DOCUMENTS

| | | | |
|---|---|---|---|
| 1307185 | 12/1989 | Japan . | |
| 2244579 | 9/1990 | Japan . | |
| 244243 | 11/1990 | Japan . | |
| 3173084 | 7/1991 | Japan . | |
| 5054950 | 3/1993 | Japan | 29/33 M |

OTHER PUBLICATIONS

"Device For Increasing The Conductor Spacing Of A Flat Cable" Translation of German Patent 2,937,689, Code PTO 90–1638, Jun. 1980.

*Primary Examiner*—Peter Vo
*Attorney, Agent, or Firm*—Charles S. Cohen

[57] ABSTRACT

An apparatus for changing intervals, or the spacing, at which selected wires are arranged in an arrangement of wires includes a lateral arrangement of linear pipes which convey wires of the wire arrangement; means for applying opposing forces to the pipes to maintain them in parallel in the arrangement; and a wire-interval changing blade assembly having a plurality of blades which intervene between selected adjacent pipes and which overcome the opposing forces applied to the pipes, thereby causing the pipe forward ends to separate from each other while allowing their rearward ends to remain close to each other, thus diverging at their forward ends.

21 Claims, 19 Drawing Sheets

APPARATUS FOR CHANGING INTERVALS AT WHICH SELECTED WIRES ARE ARRANGED IN A LATERAL ARRANGEMENT OF WIRES

FIELD OF THE INVENTION

The present invention relates generally to an apparatus for changing intervals, or spacing, at which selected wires are arranged in a lateral arrangement of wires, which apparatus is used in crimping or otherwise fixing male or female connector elements to wire ends arranged at selected intervals.

BACKGROUND OF THE INVENTION

As is well known, male or female connector elements are automatically crimped or otherwise fixed to the ends of a plurality of wires in the production of wire harnesses. Often, it is necessary to rearrange a lateral arrangement, i.e., the position, of wires so as to be at same intervals in which the male or female connector elements are arranged at the crimping stage. One conventional wire-rearranging apparatus uses a wire-passing stand having a plurality of slots arranged laterally at given intervals. Another conventional wire-rearranging apparatus uses a comb-like plate having a plurality of slots laterally arranged at given intervals in which the slots are arranged at fixed intervals. Such conventional wire-rearranging apparatuses are disclosed for instance, in Japanese Utility Model Application Public Disclosure No. 2-44243 and Patent Application Public disclosure No. 1-307185.

The arrangement of slots at fixed intervals in the comb-like plate permits a lateral wire arrangement or position to be rearranged so as to be at the same regular intervals as the slots of the comb-like plate or in the same pattern as the slots of the comb-like plate are arranged. Therefore, it is necessary to have a large supply of different comb-like plates having slots at different intervals or in different interval patterns so as to meet a variety of demands for changing wire intervals. The preparing of numerous different comb-like plates to meet occasional demands requires laborious and time-consuming work using extra jigs and tools. Accordingly, the work efficiency will be lowered.

SUMMARY OF THE INVENTION

One object of the present invention is to provide an apparatus for changing intervals or positions at which selected wires are arranged in a lateral arrangement of wires, which apparatus is capable of meeting all demands for changing wire intervals or wire-interval patterns quickly.

To attain this object, an apparatus for changing intervals at which selected wires are arranged in a lateral arrangement of wires is improved according to the present invention in that: a lateral arrangement of linear wire carriers, such as hollow pipes each allotted to each of the wires of the lateral wire arrangement; means for applying opposing forces to the linear pipes to cause the linear pipes to get close to each other; and a wire-interval changing blade assembly comprising a plurality of blades between selected adjacent linear pipes against the opposing forces applied to the linear pipes, thereby causing their forward ends to separate from each other while allowing their backward ends to remain close to each other, thus diverging forward as a whole.

With this arrangement, blades in the wire-interval changing blade assembly are selected according to a desired interval or interval pattern to allow the blades to intervene between selected adjacent linear pipes against the opposing forces applied to the linear pipes, thereby causing their forward ends to separate from each other while allowing their backward ends to remain close to each other, thus diverging forward to form a desired interval pattern. Then, wires are passed through the rearranged pipes, and the forward ends of the wires appearing from the forward ends of the pipes arranged in the same pattern as the male or female connector elements arranged in the crimping or otherwise connecting stage. When the wire-interval pattern is desired to be changed, the blades are reselected in the wire-interval changing blade assembly to intervene between selected adjacent linear pipes according to the new wire-interval pattern.

The means for applying the opposing forces to the pipes may be springs.

Each blade of the wire-interval changing blade assembly may have a tapered top, and may be equipped with a pneumatic cylinder for raising and descending the blade. Each blade may be detachably fixed to a transverse plate at a selected level. This plate may have a single pneumatic cylinder for raising and descending all the blades with respect to the lateral arrangement of linear pipes.

Each blade may be a cam detachably fixed to a shaft at a selected axial position. The cam may have rising and descending sections along its circumference, and the shaft is adapted to be rotated by an associated motor.

BRIEF DESCRIPTION OF THE DRAWINGS

Other objects and advantages of the present invention may be understood from the following description of some preferred embodiments of the present invention, which are shown in accompanying drawings.

DESCRIPTION OF PREFERRED EMBODIMENTS

Figure 1:
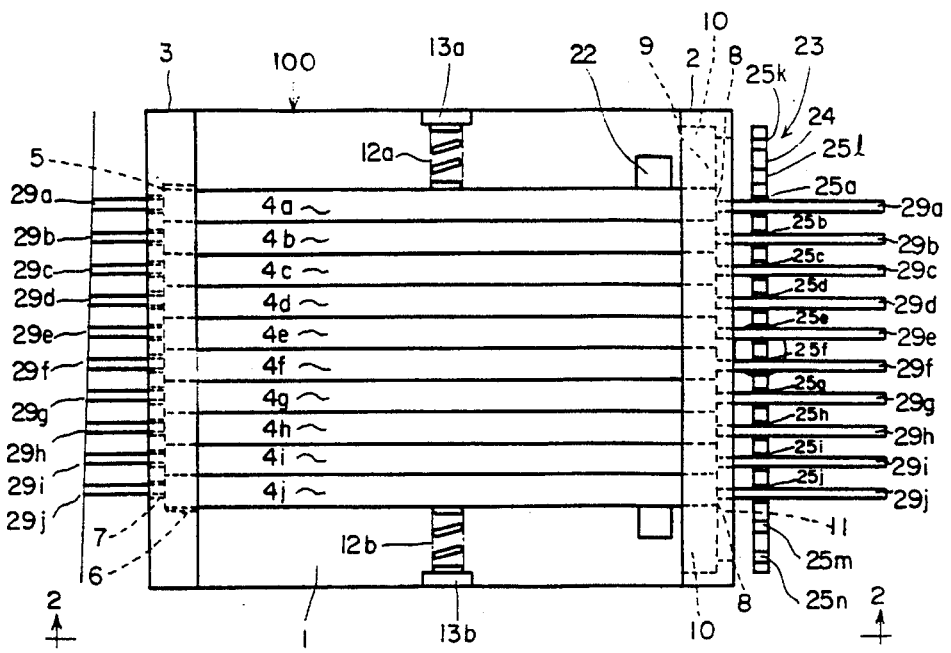
FIG. 1 is a plan view of a wire rearranging apparatus according to a first embodiment of the present invention.
Figure 2:
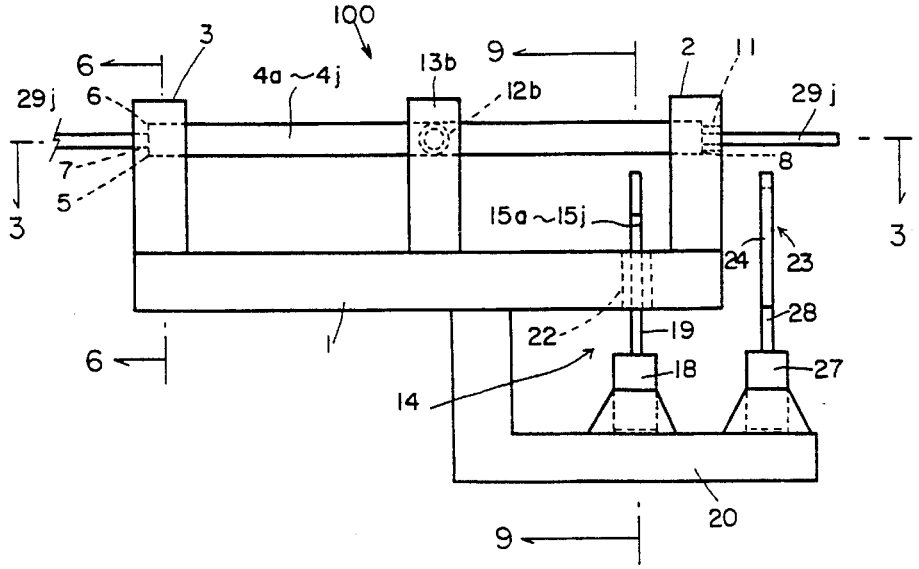
FIG. 2 is an elevational view of the wire rearranging apparatus of FIG. 1 taken along lines 2—2 thereof.
Figure 3:
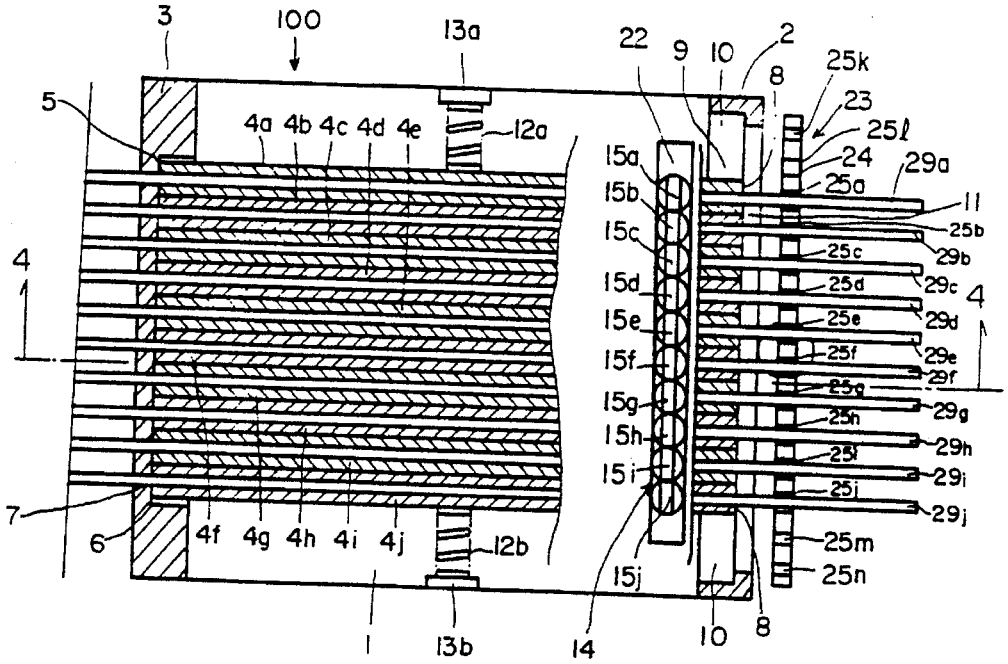
FIG. 3 is a sectional view of the wire rearranging apparatus of FIG. 2 taken along lines 3—3 thereof with a portion of the wires removed.
Figure 4:
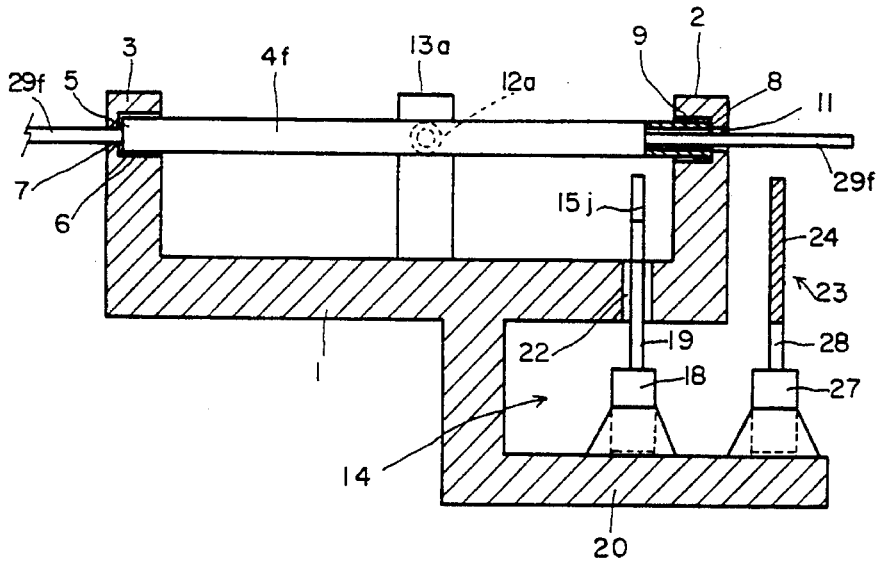
FIG. 4 is a sectional view of the wire rearranging apparatus of FIG. 3 taken along lines 4—4 thereof.
Figure 5:
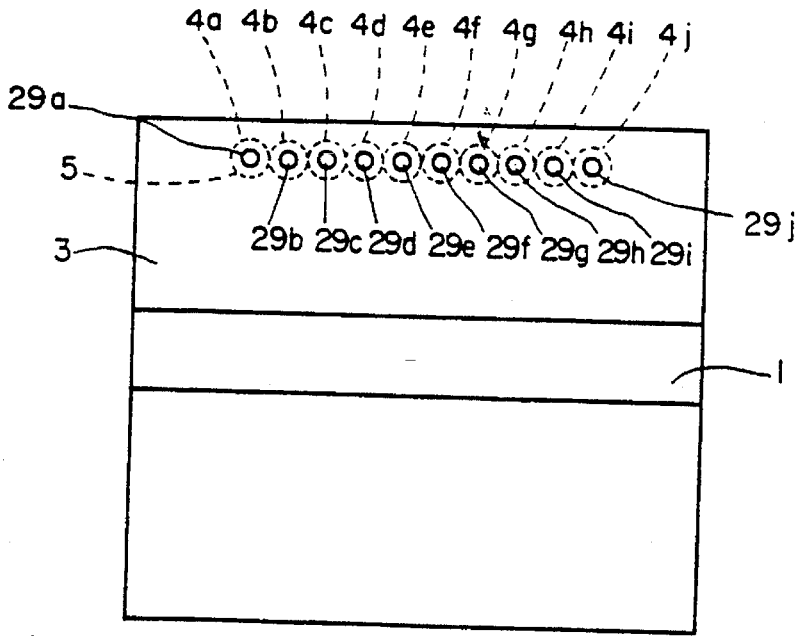
FIG. 5 is an elevational view of the wire rearranging apparatus of FIG. 2, taken from the rear of the apparatus.

Referring now to FIGS. 1 to 18, a first embodiment of a wire rearranging apparatus constructed in accordance with the principles of the present invention is generally described at 100. As seen from FIGS. 1 to 10, the apparatus 100 includes a base plate 1 with forward and rearward walls 2 and 3 rising from its forward and rearward ends. In operation, wires are fed from the rearward wall 3 to the forward wall 2. A plurality of wire-receiving carriers, illustrated as elongated pipes 4*a–j*, are arranged in parallel, extending from the forward to rearward end walls 2, 3 in perpendicular relation to these opposite end walls 2 and 3. These pipes 4*a–j* are pushed into contact with each other by opposing springs 12*a* and 12*b*, which are fixed to spring mounts 13*a* and 13*b* which are disposed at the centers of the opposite longitudinal sides of the base plate 1.

Figure 6:
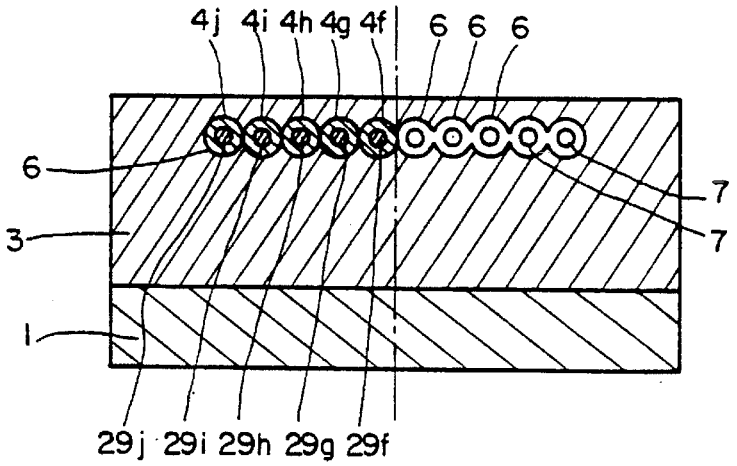
FIG. 6 is a sectional view of the wire rearranging apparatus of FIG. 2 taken along line 6—6 thereof.
Figure 7:
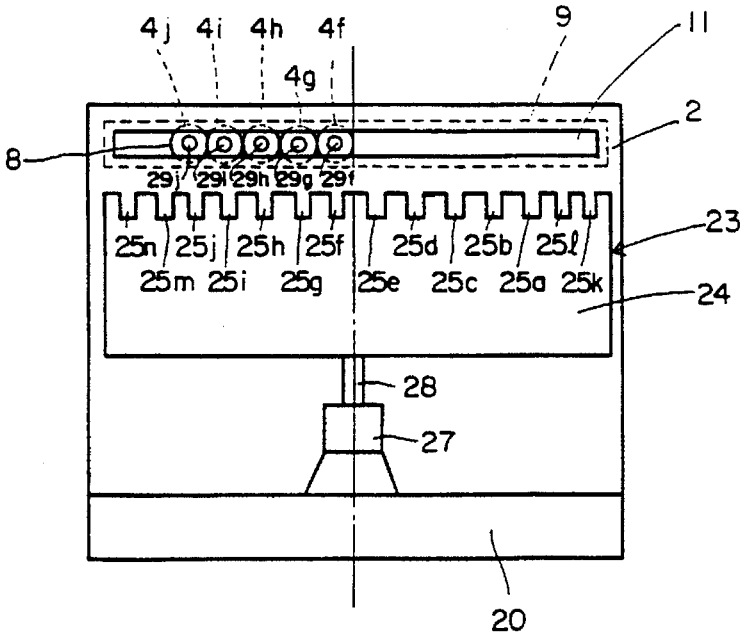
FIG. 7 is an elevational view of the wire rearranging apparatus of FIG. 2, taken from the front of the apparatus.
Figure 8:
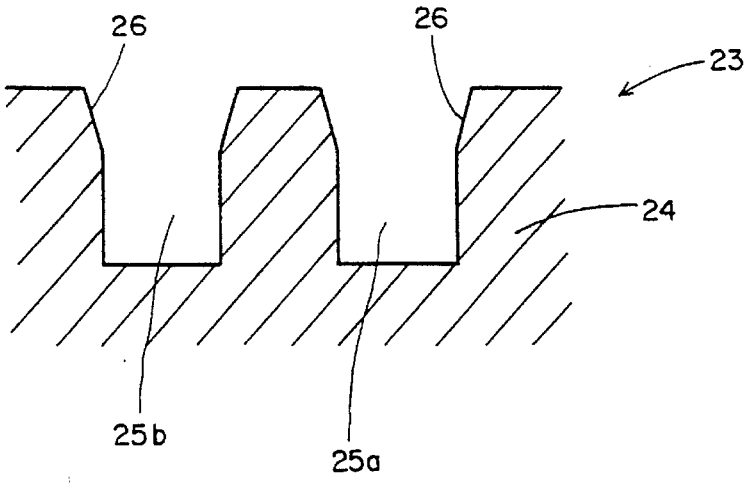
FIG. 8 is an enlarged view of a comb plate used in the wire rearranging apparatus.

As for the manner in which the parallel pipes 4*a–j* are supported by the forward and rearward walls 2, 3, it can be seen from FIG. 6, that the rearward wall 3 includes a series of circular recesses 6 to hold the rearward ends 5 of the parallel pipes 4*a–j*, which circular recesses 6 are so close as to communicate with each other on their adjacent sides, permitting the remaining upper and lower arc sections thereof to grip allotted pipe ends, preventing the pipes from shifting between adjacent recesses. Thus, parallel wire-passages 7 are defined by the circular recesses 6 and the longitudinal hollow spaces of associated pipes 4*a–j*.

The forward end wall 2 has a lateral slot 9 disposed therein in a direction transverse to the axes of the pipes 4*a–j* to loosely hold the forward ends 8 of the parallel pipes 4*a–j*. The forward end wall 2 includes an additional lateral slot 11 in communication with slot 9 to permit wires to pass therethrough after passing through the pipes 4*a–j*. As seen from FIGS. 1 and 7, extra spaces 10 are provided at the opposite ends of the lateral slot 9. Likewise, extra spaces are provided at the opposite ends of the lateral slot 11. Thus, the forward end 8 of each pipe can move laterally with its rearward end 5 remaining at its fixed center to form a divergent pattern of pipe arrangement. As seen from FIG. 2, the lateral slot 9 has a vertical size somewhat larger than the lateral slot 11, thus forming a step therebetween to thereby to prevent the forward ends of the parallel pipes 4*a–j* from going beyond the forward end wall 2.

A wire-interval changing blade assembly 14 is provided with the apparatus 100 and is disposed under the pipes 4*a–j* just behind their forward ends.

Figure 9:
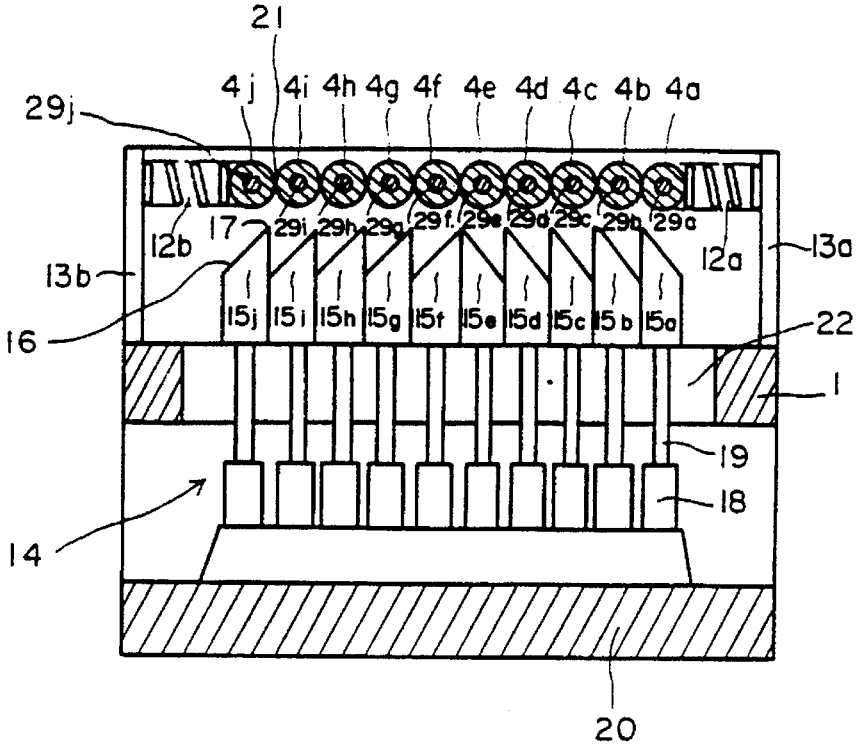
FIG. 9 is a sectional view of the wire rearranging apparatus of FIG. 2 taken along line 9—9 thereof.

As best shown in FIG. 9, the wire-interval changing blade assembly 14 comprises a plurality of displacement members, such as blades 15*a–j*, preferably equal in number to the number of pipes 4*a–j* (ten in this particular embodiment 100), and associated pneumatic cylinder 18 and pistons 19 for raising and lowering the blades 15*a–j* relative to the overlying 4*a–j*. Each blade has a tapered end 17. The tapered end 17 has a slanted surface 16, which can intervene between adjacent tubes at the pipe boundary lines indicated at 21. All blades 15*a–j* are arranged so as to put their tapered ends 17 in alignment with the boundary lines 21 defined between adjacent pipes.

In this particular embodiment the pneumatic cylinders 18 are fixed to a base 20 in the vicinity of the forward end wall 2, and all of the blades 15*d–j* are arranged so as to permit the rising and descending of the blades through a lateral slot 22 formed in the overlying base 1, thereby intervening between and withdrawing from the pipes 4*a–j*.

A wire-interval correction unit 23 may be disposed ahead of the forward end wall 2 and includes a comb plate 24, a pneumatic cylinder 27 and an associated piston 28 for raising and lowering the comb plate 24. The comb plate 24 has a plurality of slots 25*a–n* arranged at regular intervals for accepting wires appearing from the forward ends of the pipes 4*a–j*. The comb plate 24 is placed in the vicinity of the forward end wall 2. As best seen from FIG. 10, the comb plate 24 has chamfered tooth projections which define divergent spaces between adjacent tooth projections.

Figure 10:
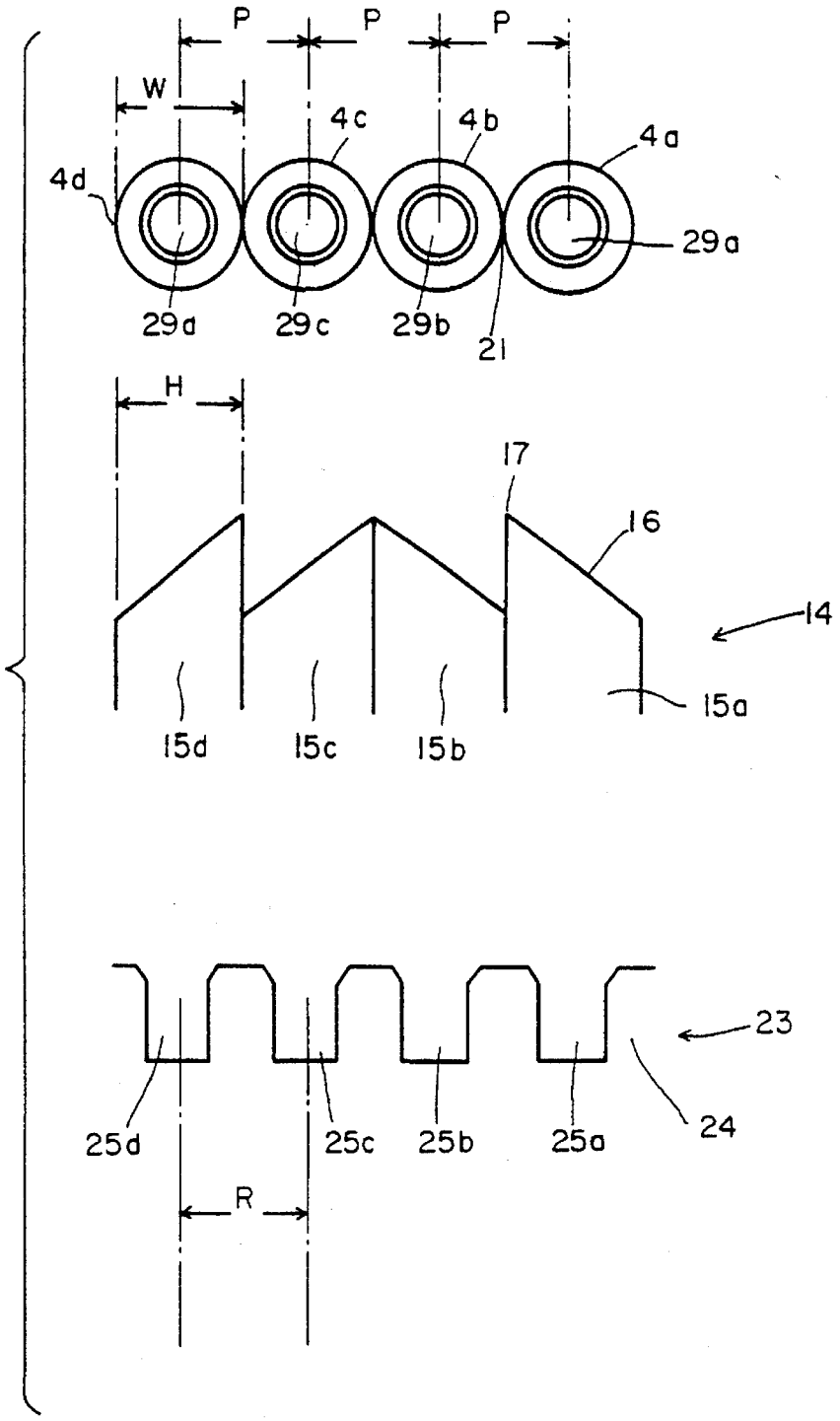
FIG. 10 is a diagrammatic view illustrating the relative positions of the linear pipes, the wires and the slots of the comb plate of the wire rearranging apparatus.

FIG. 10 illustrates how the interval, or pitch P, between adjacent wires 29*a–j*, the outer diameter W of the pipes 4*a–j*, the width H of the blades 15*a–j* and the pitch R between adjacent slots 25*a–n* are related. In operation, the wires 29*a–j* are inserted in the pipes 4*a–j* with their longitudinal axes exactly aligned with each other, and all pipes 4*a–j* are maintained in a parallel arrangement with each other by the springs 12*a*, 12*b* so that the interval, or pitch P, between adjacent wires 29*a–j* is equal to the outer diameter W of the pipe 4*a–j*.

Even if wires are somewhat offset from their common longitudinal axes, the interval, or pitch, P between adjacent wires is substantially equal to the outer diameter W of the pipe because the offset is negligible as compared with the wire-interval P or pipe diameter W.

The width H of each blade 15*a–j*, the slot pitch R of the comb-like plate 24, the wire interval P and the outer diameter W of each pipe 4*a–d* are preferably equal to each other, and the width of each slot 25*a–n* is adequate to allow the wire to fit therein.

Referring to FIGS. 11 to 18, the operation of the wire-interval changing apparatus according to the first embodiment shall now be described. A plurality of wires 29*a–j* are arranged at regular intervals P, and the wires 29*a–j* are fed into the wire-interval changing apparatus 100. In instances where the wire-interval changing apparatus is used in combination with an apparatus for crimping and fixing male or female connector pieces to wire, the wires to be fed into the wire-interval changing apparatus are cut to a predetermined length before feeding into the wire-interval changing apparatus.

Figure 11:
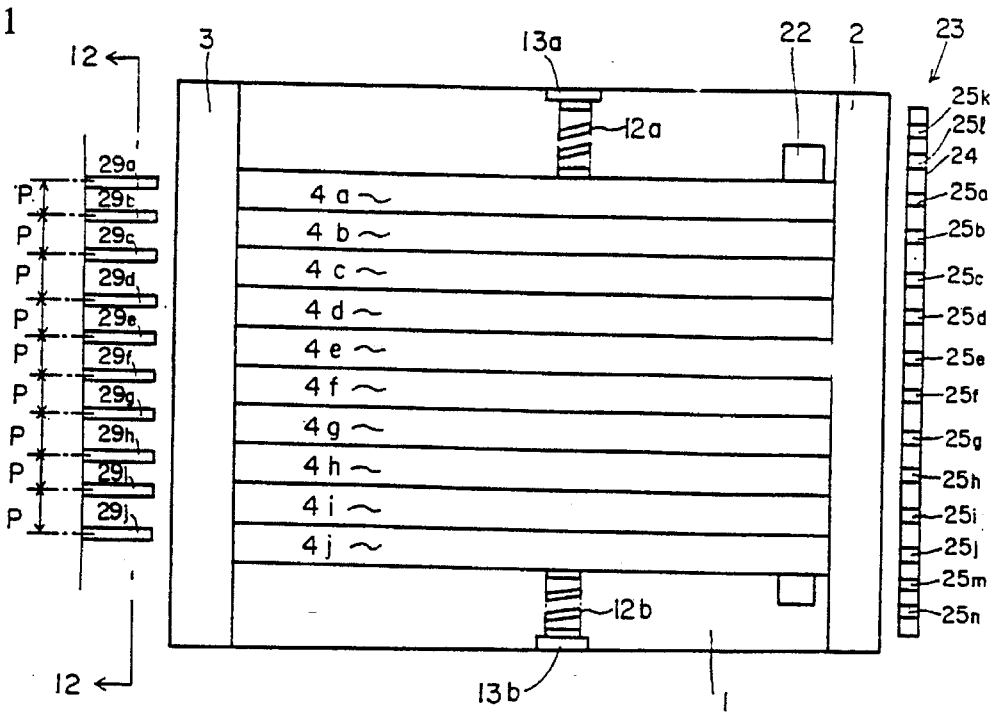
FIG. 11 is a plan view of the wire rearranging apparatus of FIG. 2, illustrating how the linear pipes are arranged in parallel at the outset.
Figure 12:
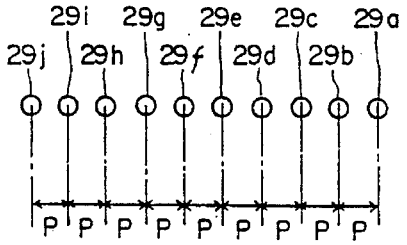
FIG. 12 is a sectional view of the wire rearranging apparatus of FIG. 11 taken along line 12—12 thereof.
Figure 15:
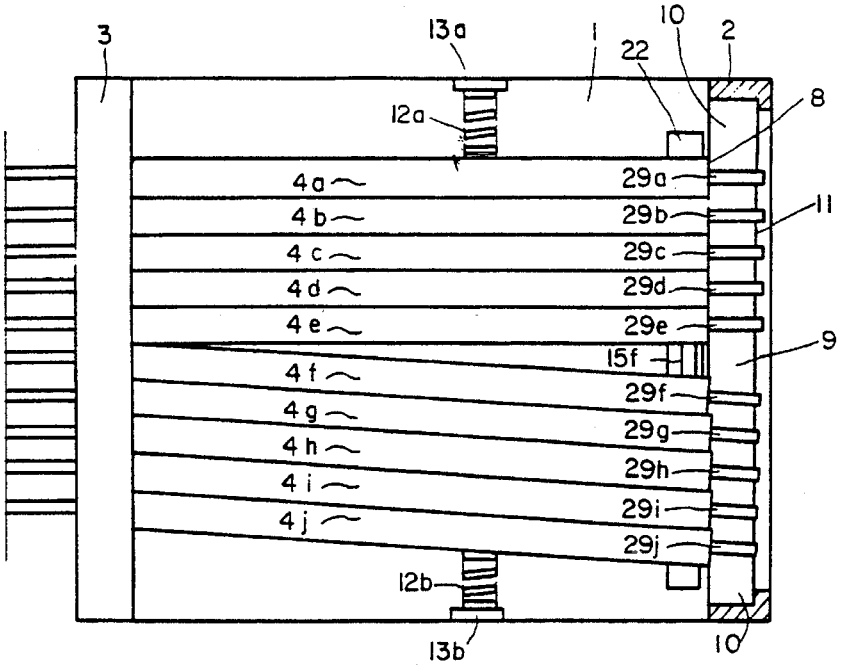
FIG. 15 is a plan view similar to FIG. 13, but showing that all wires are not corrected in position.

Prior to the feeding of wires into the wire-interval changing apparatus, the intervals at which selected pipes containing at least two wires are changed. A description is now given as to how the arrangement pattern of FIGS. 11 and 12 is changed to the arrangement pattern of FIGS. 13, 14 and 15. Specifically, the interval between the wires 29*e* and 29*f* is changed while the other wires remain at same intervals P. Accordingly, the interval between the pipes 4*e* and 4*f* in which the wires 29*e* and 29*f* are to be inserted is changed as follows. The blade 15*f* is raised by the pneumatic cylinder 18 until its tapered end has intervened between the pipes 4*e* and 4*f*, thereby permitting the slanted surface of the tapered end to push the pipes 4*f*, 4*g*, 4*h*, 4*i* and 4*j* toward the spring 12*b* while the spring 12*b* is yieldingly compressed, as seen in FIG. 15. The pipes 4*a*–4*e* remain stationary because the straight side of the tapered end of the blade 15*f* slides on the pipe 4*e*, causing no pushing, or shifting, force on the pipe 4*e*, whereas the slanted surface of the blade 15*f* causes a pushing force on the pipe 4*f* like a wedge. Thus the forward ends of pipes 4*f–j* are shifted as a whole in the lateral slot 9 of the forward end wall 2 while the rearward ends of pipes 4*f–j* remain stationary in the rearward end wall 3, thus forming a divergent pattern of pipe arrangement. The wires 29*a–j* are subsequently inserted in the pipes 4*a–j*. Specifically, the wires 29*a–e* are inserted in the pipes 4*a–e*, which extend perpendicular to the rearward and forward end walls 3 and 2, and the wires 29*f–j* are inserted in the pipes 4*f–j*, which are shifted away from the wires 29*a–j*. Thus, the wires 29*a*–29*j* when exiting from the pipes 4*a*–4*j* are changed partly in their interval, and particularly, the wires 29*e* and 29*f* are arranged at intervals which are different from those of the other wires.

Figure 13:
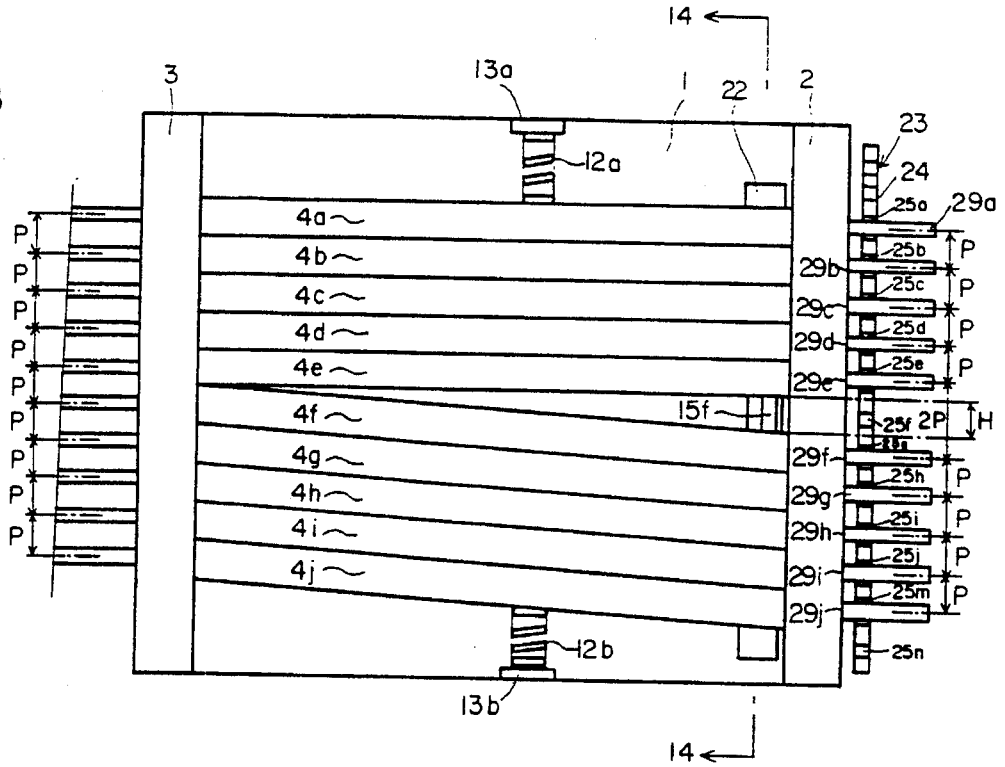
FIG. 13 is a plan view of the wire rearranging apparatus of FIG. 11 illustrating how the linear pipes are separated into two groups by a selected blade to provide a divergent form, and that all wires are corrected in position by an associated pitch correction means.
Figure 14:
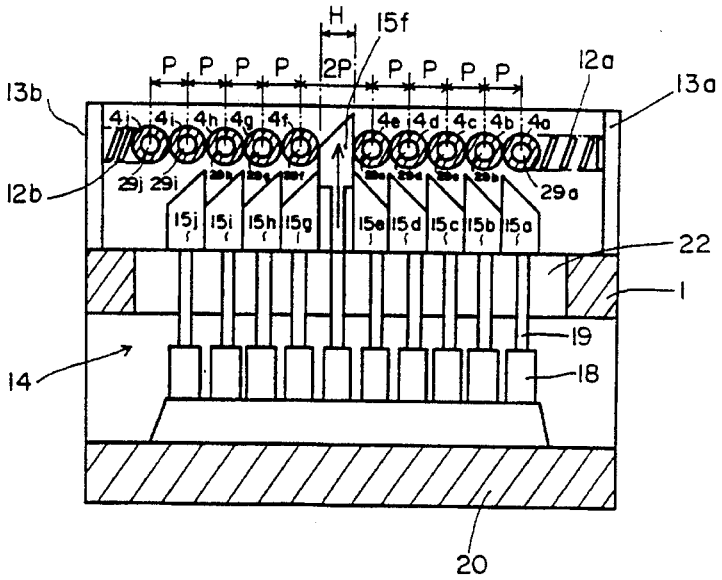
FIG. 14 is a sectional view of the wire rearranging apparatus of FIG. 13 taken along line 14—14 thereof.

The blade width H is equal to the wire interval or pitch P, and therefore the pipes 4*e* and 4*f* are separated by a two-pitch distance, and accordingly, the wires 29*e* and 29*f* are separated by a two-pitch distance. The pipe 4*f* is inclined, and therefore the distance between the pipes 4*e* and 4*f* and hence between the wires 29*e* and 29*f* is not exactly equal to two pitches, but almost equal to two pitches. All wires 29*a–j* appear above the wire interval correction unit 23, and then the comb plate 24 is raised by the pneumatic cylinder 27 and the piston 28 so that the forward ends of all wires 29*a–j* are fitted in the slots 25*a–n*. The forward ends of the wires 29*a–e* extend straight in alignment with corresponding slots of the comb plate 24. The forward ends of the wires 29*f–j*, however, extend somewhat slanted, accordingly deviating a little from the exact alignment with corresponding slots 25*g*–25*m* of the comb plate 24. The comb plate 24 is positioned close to the forward wall 2, and therefore the chamfered teeth of the comb plate can catch the forward ends of the wires 29*f–j*, the degree of deviation of which remains small because of a small-distance extension beyond the forward wall 2. Thus, these wires 29*f–j* are yieldingly bent to fit in corresponding slots 25*g–m* with the result their interval is changed exactly to a two-pitch distance, as shown in FIG. 13. The deviation of the wire within the pipe from its longitudinal, center axis can be reduced by allowing it to be fitted in the corresponding slot of the comb plate 24.

As may be understood, when the wires exit from the forward ends 8 of the pipes 4*a–j*, the wire-interval correction unit will put all the wires 29*a–j* into the exact pattern of wire arrangement as desired.

Figure 16:
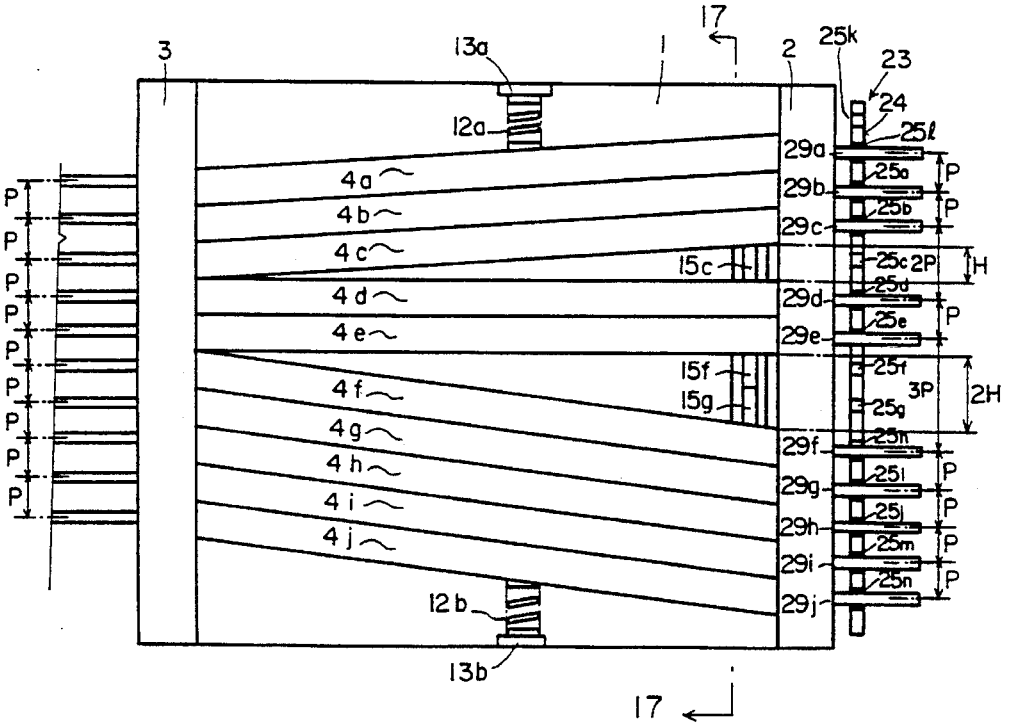
FIG. 16 is a plan view of the wire rearranging apparatus, showing partly in section, that the linear pipes are separated into three groups by one selected blade and two selected adjacent blades to provide a divergent form, and that all wires are corrected in position by an associated pitch correction means.
Figure 17:
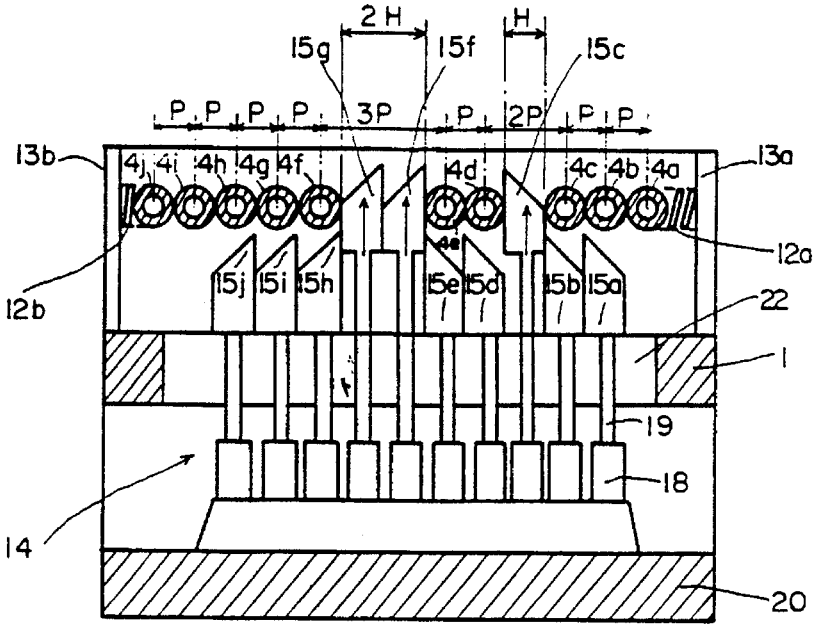
FIG. 17 is a sectional view of the wire rearranging apparatus of FIG. 16 taken along line 17—17 thereof.
Figure 18:
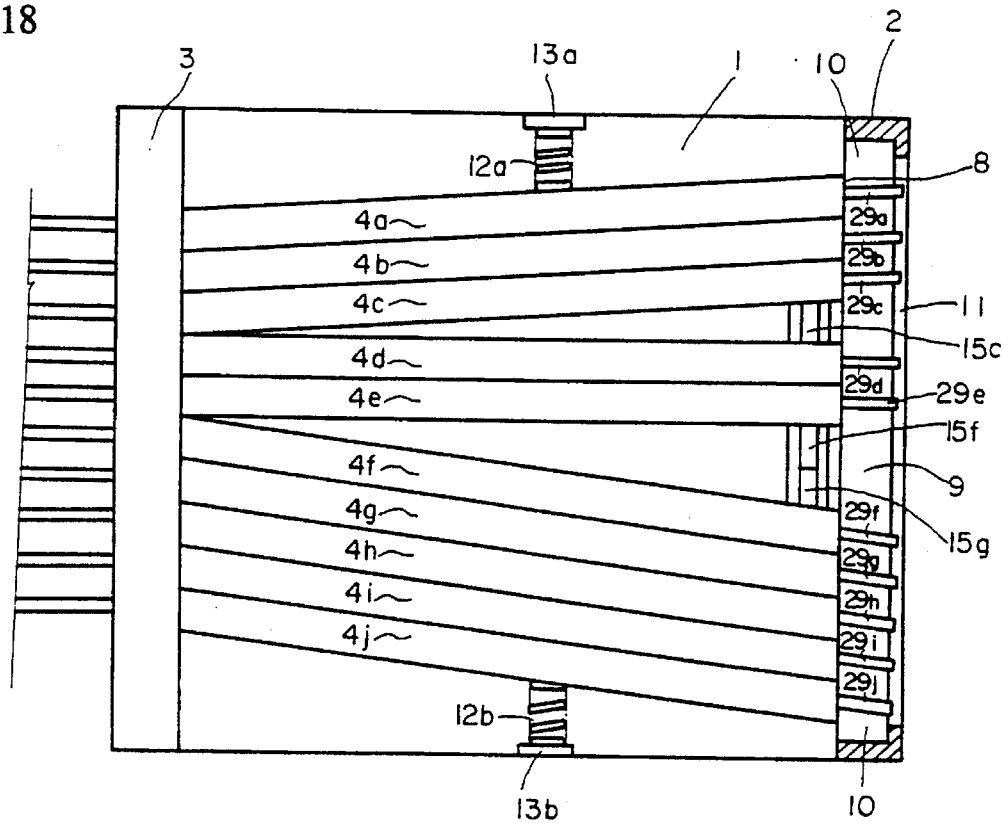
FIG. 18 is a plan view similar to FIG. 16, but showing that all wires are not corrected in position.
Figure 19:
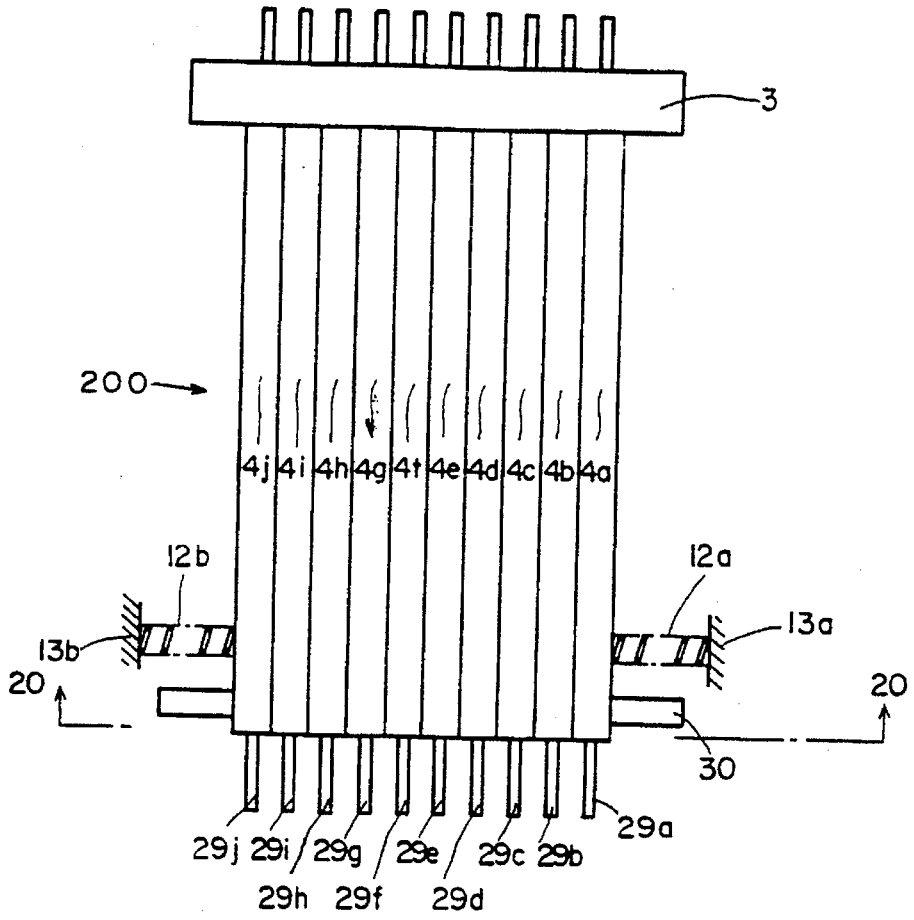
FIG. 19 is a plan view of a second embodiment of a wire rearranging apparatus according to the present invention, illustrating how the wires are inserted in the pipes arranged close in parallel.
Figure 20:
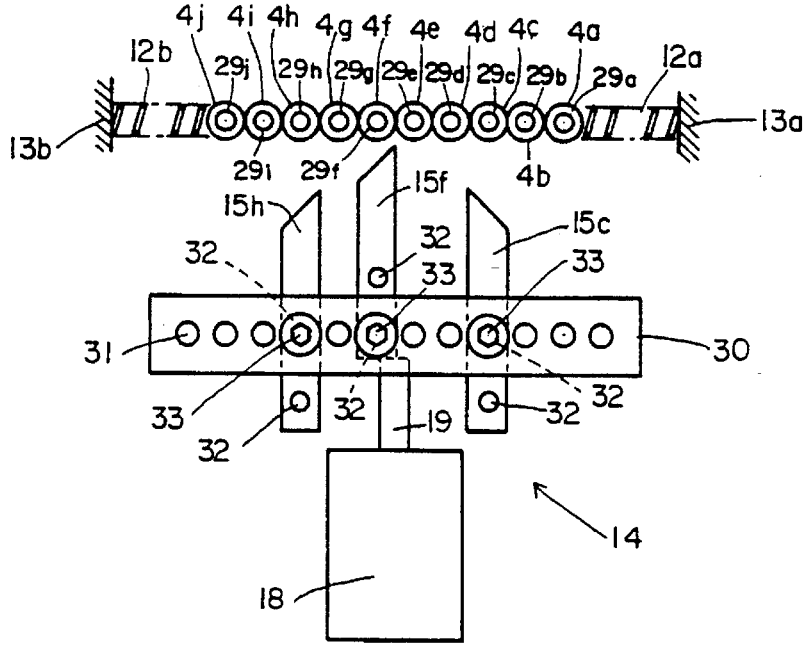
FIG. 20 is a sectional view of the wire rearranging apparatus of FIG. 19 taken along line 20—20 thereof.

FIGS. 16, 17 and 18 illustrate how the wires 29*a–j* are rearranged to form another pattern of wire arrangement, in which the wires 29*c* and 29*d* are separated by a two-pitch distance (2P), and the wires 29*e* and 29*f* are separated by a three-pitch distance (3P). First, the blades 15*c* and 15*f* are raised to intervene between the pipes 4*c* and 4*d* and between the pipes 4*d* and 4*f*, respectively, thereby pushing a group of pipes 4*a*–4*c* toward the spring 12*a*, and at the same time, another group of pipes 4*f–j* toward the spring 12*b*. Thereafter, the blade 15*g* is raised to intervene between the blade 15*f* and the pipe 4*f*, thereby further shifting the group of pipes 4*f–j* toward the spring 12*b*, as seen in FIGS. 17 and 18. When the wires 29*e* and 29*f* exit from the forward ends 8 of the pipes 4*a–j*, the wire-interval correction unit puts all wires 29*a–j* into the exact pattern of wire arrangement, as shown in FIG. 16.

The raising-and-lowering of selected blades may be controlled according to a computer program, which is prepared to cause selected pipes to be separated from each other thereby to form a plurality of wire arrangement patterns one after another as desired. Thus, automatic wire-rearrangement can be effected without changing the blade assembly.

Referring now to FIGS. 19 to 24, a second embodiment of a wire-interval changing apparatus 200 according to the present invention is illustrated as using a single pneumatic cylinder 18 in place of a plurality of pneumatic cylinders in the first embodiment 100. As seen from FIGS. 20, 22 and 24, the pneumatic cylinder 18 has an associated piston 19 and a cross plate 30, which has a plurality of holes 32 laterally arranged at regular intervals. Each blade has two holes 31 for adjusting its level with respect to the cross plate 30. As shown in these drawings, the blades 15*c*, 15*f* and 15*h* are fixed to the cross plate 30 by inserting bolts 33 in the selected holes 32 of the blades 15*c*, 15*f* and 15*h* and in selected holes 13 of the cross plate 30, and by fastening these blades and the cross plate 30 with the bolts and nuts 33.

Figure 24:
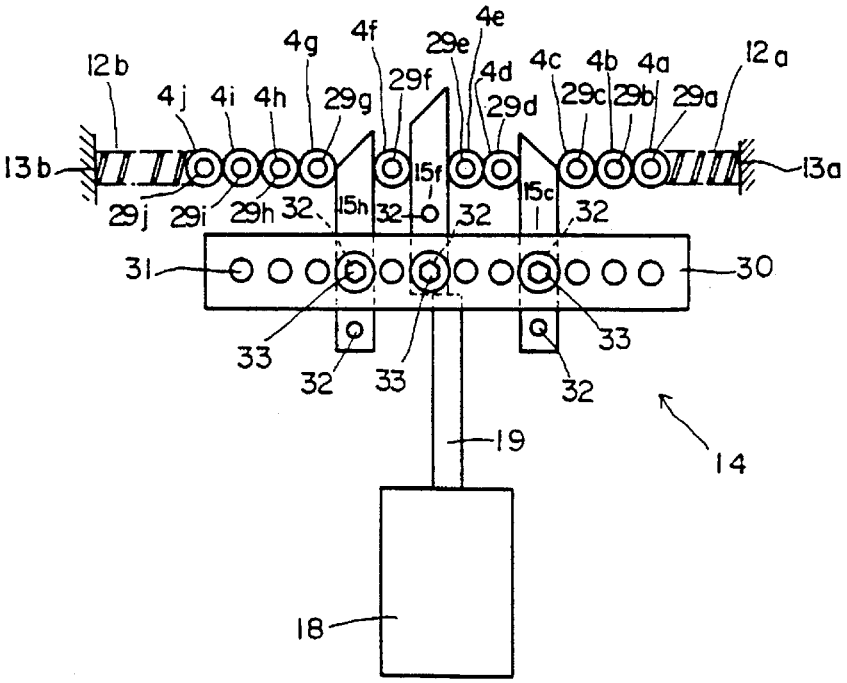
FIG. 24 is a sectional view of the wire rearranging apparatus of FIG. 23 taken along line 24—24 thereof.
Figure 25:
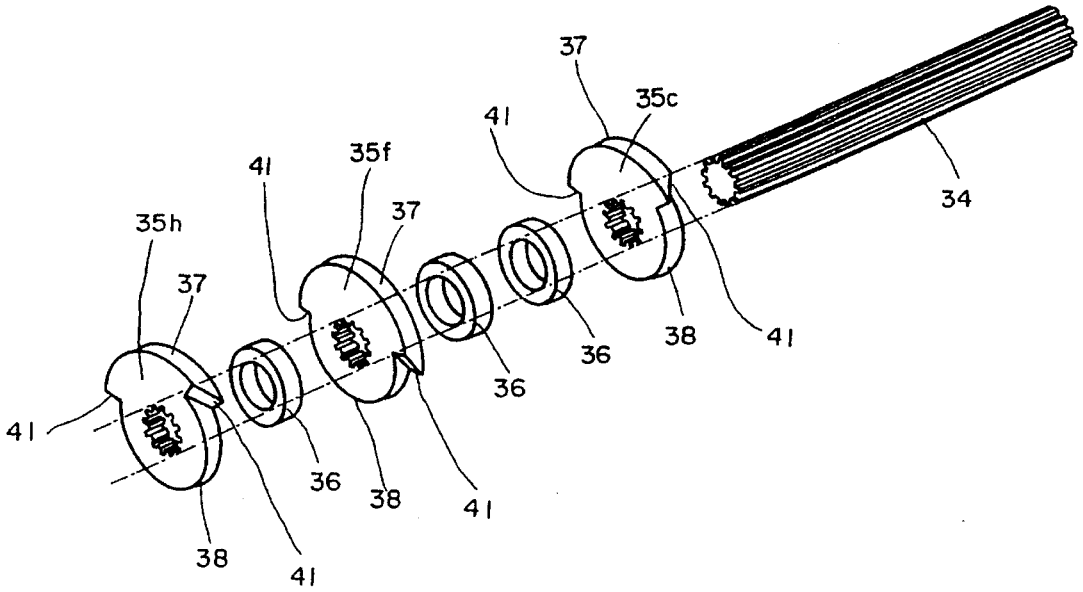
FIG. 25 is a perspective, exploded view of a wire-interval changing blade assembly used in the wire rearranging apparatus of FIG. 26.

In this particular embodiment, center blade 15*f* is fixed to the cross plate 30 by using the lower hole 32 whereas the right and left blades 15*c* and 15*h* are fixed to the cross plate 30 by using the upper holes 32. When the piston 19 is raised by the pneumatic cylinder 18 to raise the cross plate 30, the blade 15*f* intervenes between the pipes 4*e* and 4*f* (FIG. 22), and thereafter the blades 15*c* and 15*h* intervene between the pipes 4*c* and 4*d* and between the pipes 4*f* and 4*g*, respectively (FIG. 24). Thus, the wire-arrangement is changed from FIGS. 19 and 20 to FIGS. 21 and 22 (the pipes 4*e* and 4*f* being separated to separate the wires 29*e* and 29*f* by a two-pitch distance), and then to FIGS. 23 and 24 (the pipes 4*e* and 4*f*, 4*c* and 4*d*, and 4*g* and 4*f* being separated to separate the wires 29*e* and 29*f*, 29*c* and 29*d*, and 29*g* and 29*f* by a two-pitch distance).

Figure 21:
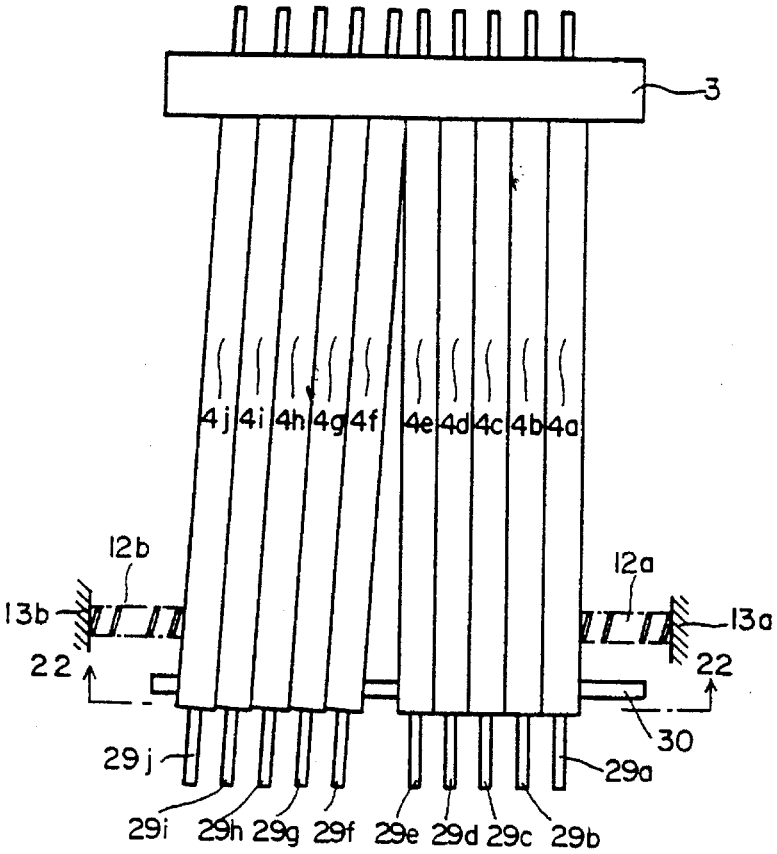
FIG. 21 is a plan view illustrating the linear pipes separated into two groups by a selected blade to define a divergent form, and that all wires are not corrected in position by an associated pitch correction means.
Figure 22:
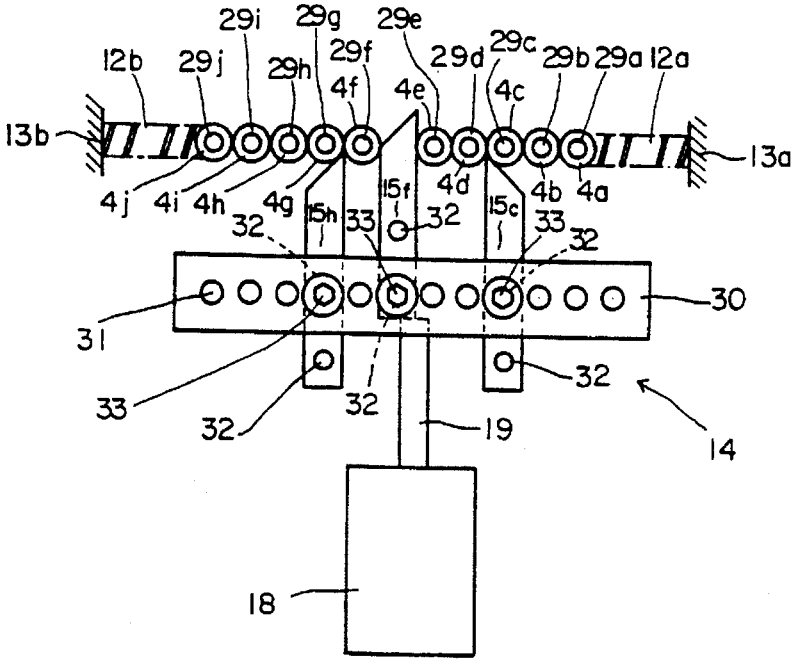
FIG. 22 is a sectional view of the wire rearranging apparatus of FIG. 21 taken along line 22—22 thereof.
Figure 23:
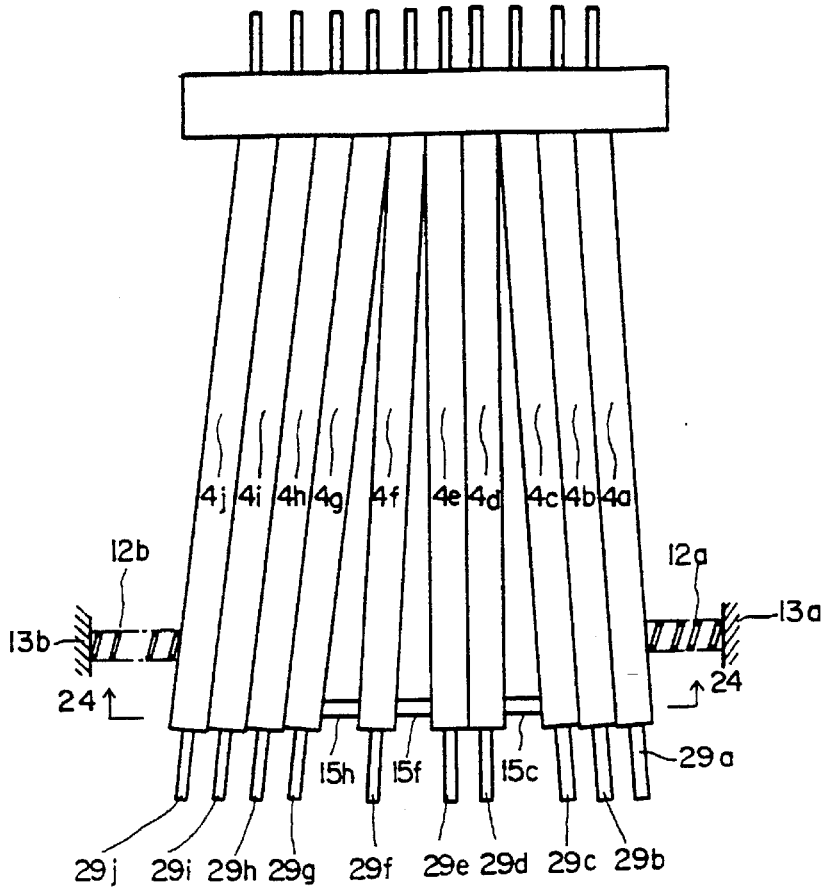
FIG. 23 is a plan view of the wire rearranging apparatus, showing that the linear pipes are separated into four groups by three selected blades to provide a divergent form, and that all wires are not corrected in position by an associated pitch correction means.

More specifically, as seen from FIGS. 21 and 22, the piston 19 is raised by the pneumatic cylinder 18 so that a group of pipes 4*a–e* are shifted toward the spring 12*a* and so that another group of pipes 4*f–j* are shifted toward the spring 12*b*. The piston 19 is further raised to cause the blades 15*c* and 15*h* intervene between the pipes 4*c* and 4*d* and between the pipes 4*f* and 4*g* (FIG. 24) until the forward ends of the wires 29*c* and 29*d*, and 29*f* and 29*g* are separated by a two-pitch distance, respectively. The wire intervals are finally corrected by the comb plate 24 of the wire-interval correction unit 23.

Referring to FIGS. 25 to 29, a third embodiment of a wire-interval changing apparatus 300 is illustrated as using a cam blade assembly 14 for changing the wire intervals.

The cam blade assembly 14 comprises a splined shaft 34, cam-shaped blades 35*c*, 35*f* and 35*h* and adjusting rings 36. The splined shaft 34 is supported at one end by a bearing 40, and is connected at the other end to the shaft of a control means, such as a stepping motor 39. If occasions demand, the stepping motor 39 may be connected to the cam blade assembly 14 via a reduction gearing unit. The cam-shaped blades 35*c*, 35*f* and 35*h* are adjusted in position along the splined shaft 34 by intervening rings 36 in order to select and raise tubes according to a desired pattern of wire arrangement. In this particular embodiment, a splined shaft 34 is used to permit the cam-shaped blades 35*c*, 35*f* and 35*h* to be detachably fixed to the shaft, but any conventional means may be used to permit the detachable fixing of cam-shaped blades to the shaft.

Figure 27:
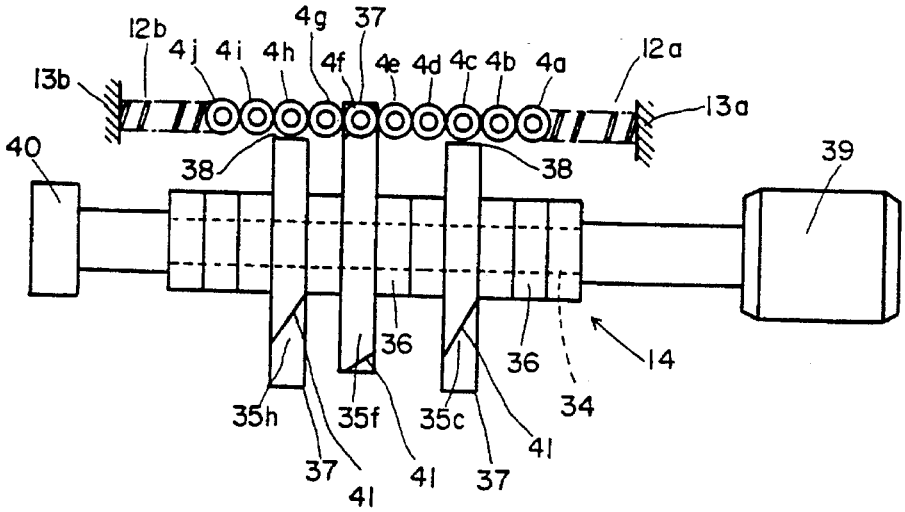
FIG. 27 is a sectional view of the wire rearranging apparatus of FIG. 26 taken along line 27—27 thereof.

Each ring 36 has a width equal to the outer diameter of the associated pipe. Referring to FIG. 27, the cam-shaped blades 35, 35*f* and 35*h* are arranged on the splined shaft 34 with two rings 36 intervening between the cam-shaped blades 35*c* and 35*f*, and with one ring 36 intervening between the cam-shaped blades 35*f* and 35*h*, thus putting the cam-shaped blades 35*c*, 35*f* and 35*h* in alignment with the tubes 4*c*, 4*f* and 4*h* respectively. All of the cam-shaped blades 35*c*, 35*f* and 35*h* preferably have the same shape, that is, with similar rising-and descending-sections 37 and 38. In the Figures, particularly in FIGS. 27 & 29, the boundary between the rising- and descending-sections 37 and 38 is indicated by inclined line 41. The cam-shaped blades 35*c* and 35*h* are fixed to the splined shaft 34 with their rising sections 37 at same angular positions, and the cam-shaped blade 35*f* is fixed to the splined shaft 34 with its rising section 37 at a different angular position.

Figure 26:
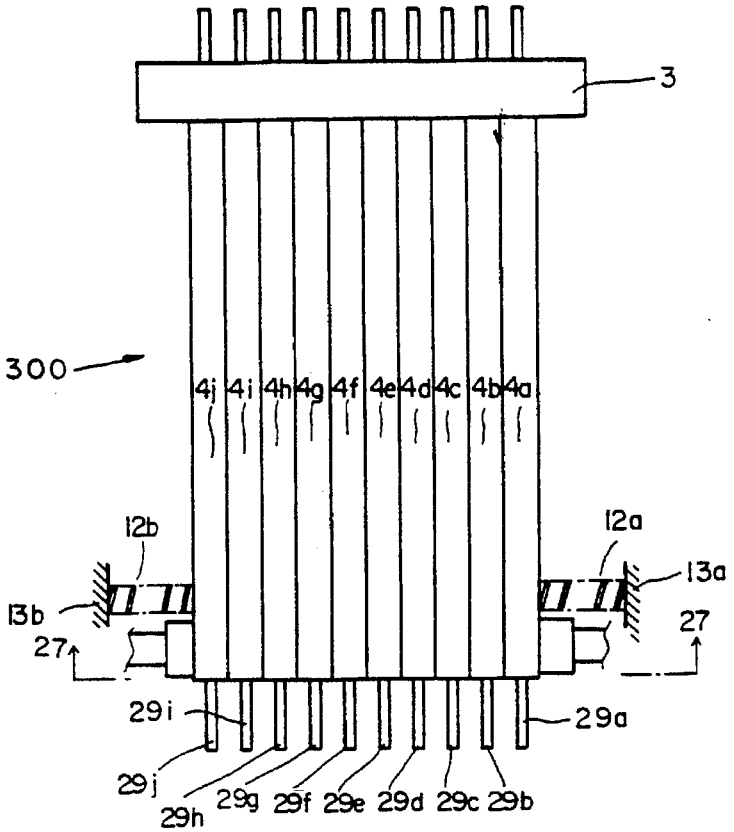
FIG. 26 is a plan view of a third embodiment of a wire rearranging apparatus according to the present invention, illustrating the wires inserted in the pipes parallel.
Figure 31:
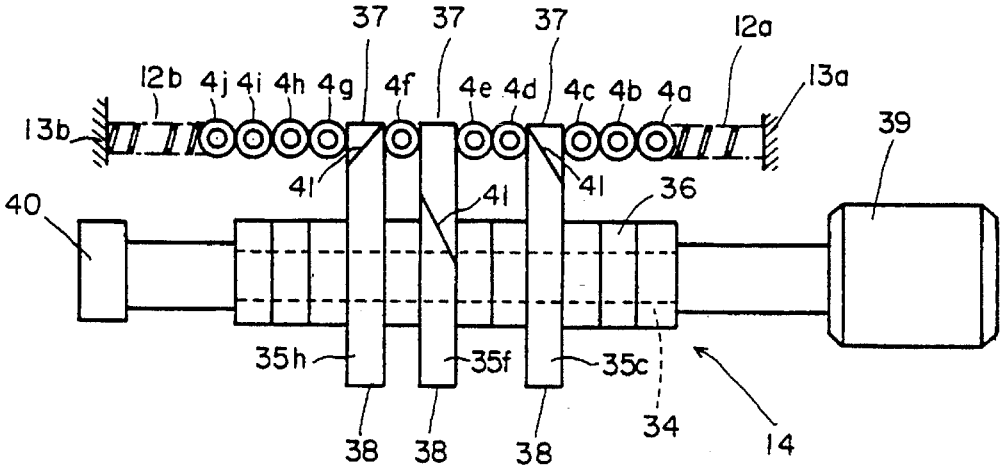
FIG. 31 is a sectional view of the wire rearranging apparatus of FIG. 30 taken along line 31—31 thereof.

As seen from FIGS. 26 and 27, no cam-shaped blades intervene between the overlying pipes, but the rising-section of the cam-shaped blade 35*f* is about to intervene between the pipes 4*e* and 4*f*, and the splined shaft 34 is rotated to cause the rising-section of the cam-shaped blade 35*f* to intervene between the pipes 4*e* and 4*f*, pushing the pipes 4*f–j* toward the spring 12*b* as the right-to-left downwardly inclined wall 41 of the rising-section 37 of the cam-shaped blade 35*h* (FIG. 31) functions like wedge against the pipe 4*g* to push the pipes 4*g–j* away from the pipe 4*f*. Thus, the forward end of the pipe 4*c* is put away from the forward end of the pipe 4*d* by a distance equal to the width of the cam-shaped blade 35*c*, and the forward end of the pipe 4*g* is put away from the forward end of the pipe 4*f* by the distance equal to the width of the cam-shaped blade 35*h*.

Figure 28:
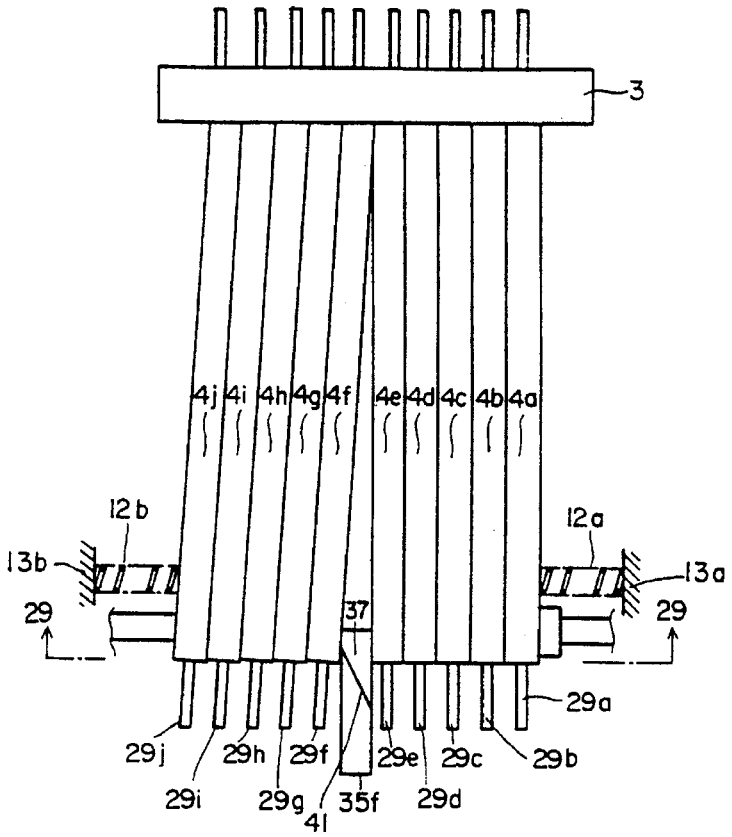
FIG. 28 is a plan view of a wire rearranging apparatus illustrating how the linear pipes are separated by a selected cam blade into two groups, thus defining a divergent form, and that all wires are not corrected in position by an associated wire-pitch correction means.
Figure 29:
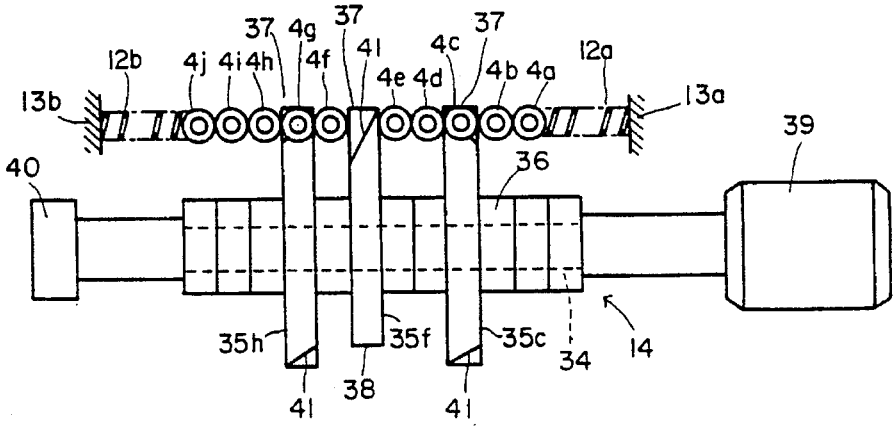
FIG. 29 is a sectional view of the wire rearranging apparatus of FIG. 28 taken along line 29—29 thereof.
Figure 30:
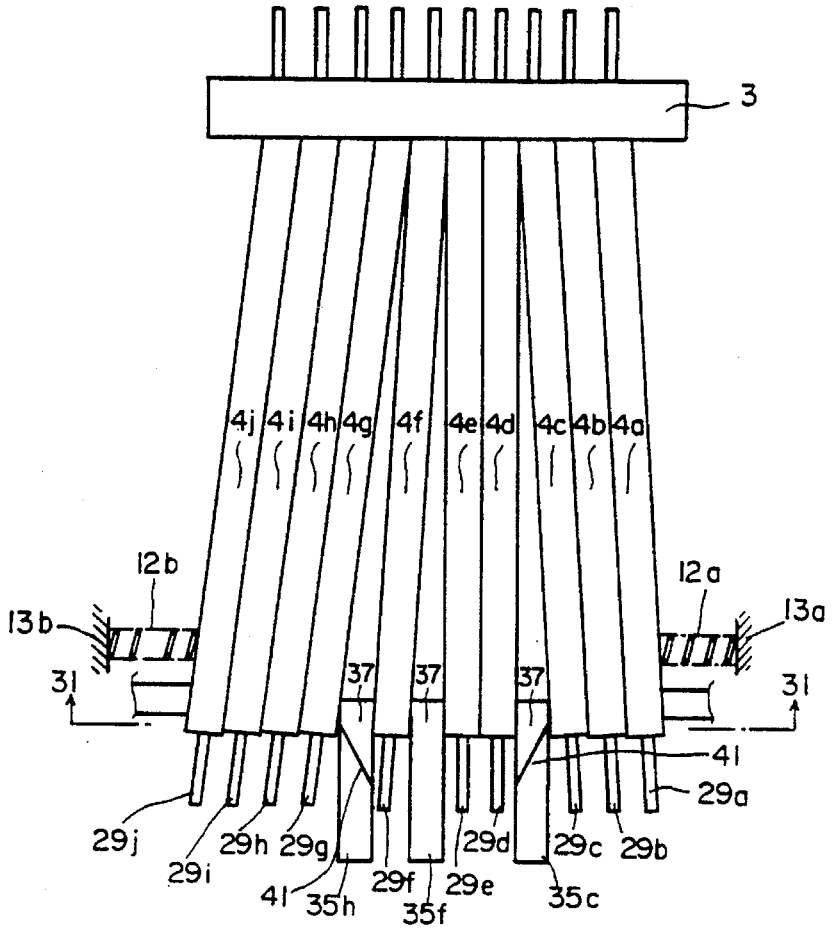
FIG. 30 is a plan view of the wire rearranging apparatus, illustrating the linear pipes separated by three selected cam blades into four groups, and that all wires are not corrected in position.

If the wires 29*a–j* are fed into the wire-interval changer whose pipes 4*a–j* are arranged as shown in FIG. 28, the wires 29*a–j* are separated into two groups (one group including the wires 29*a–e*, the other group including the wires 29*f–j*) with the wires 29*e* and 29*f* separated by a two-pitch distance away from each other. If the wires 29*a–j* are fed into the wire-interval changer whose pipes 4*a–j* are arranged as shown in FIG. 30, the wires 29*a–j* are separated into four groups (the first group including the wires 29*a–c*; the second group including the wires 29*d–e*; the third group including the wire 29*f*; and, the fourth group including the wires 29*g–j*) with the wires 29*c* and 29*d*; 29*e* and 29*f*; and 29*f* and 29*g* being separated by a two-pitch distance. All wire intervals can be corrected with the aid of the comb plate 24 of the wire-interval correction unit 23.

Figure 32:
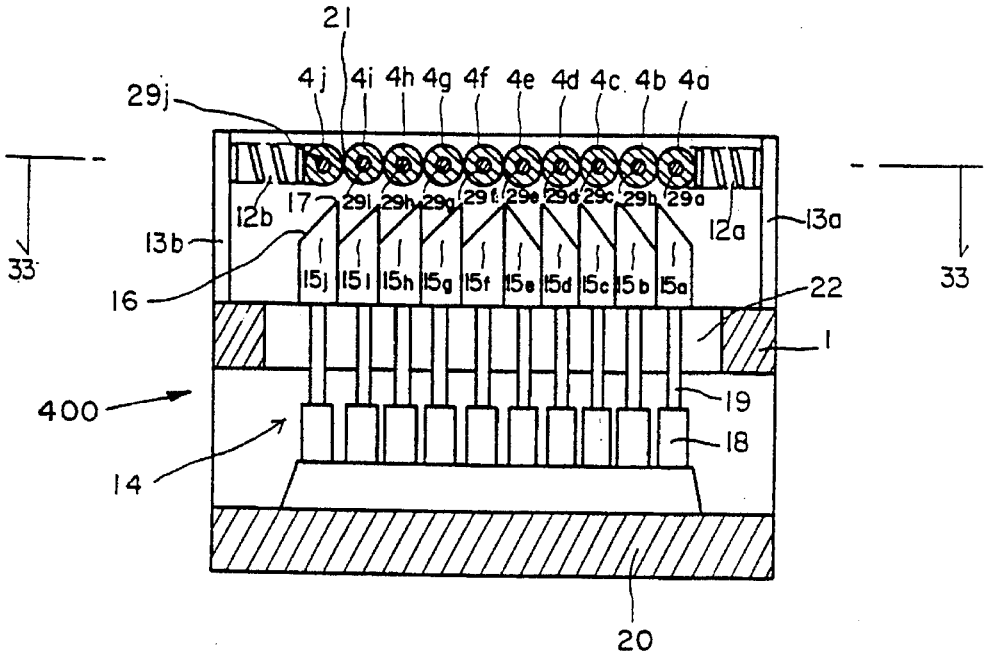
FIG. 32 is a sectional view of a wire rearranging apparatus according to a fourth embodiment of the present invention.
Figure 33:
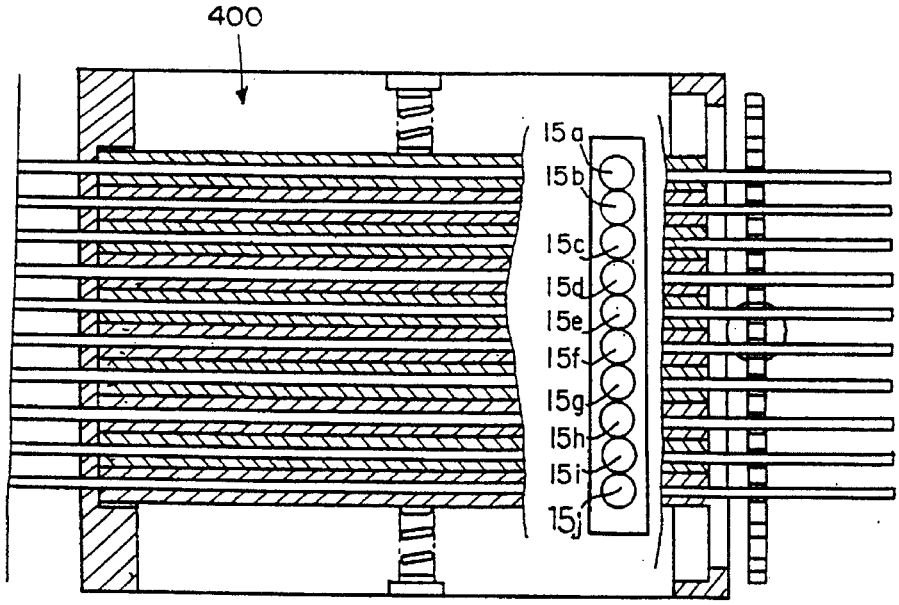
FIG. 33 is a sectional view, partly broken, of the wire rearranging apparatus of FIG. 32 taken along line 33—33 thereof.
Figure 34:
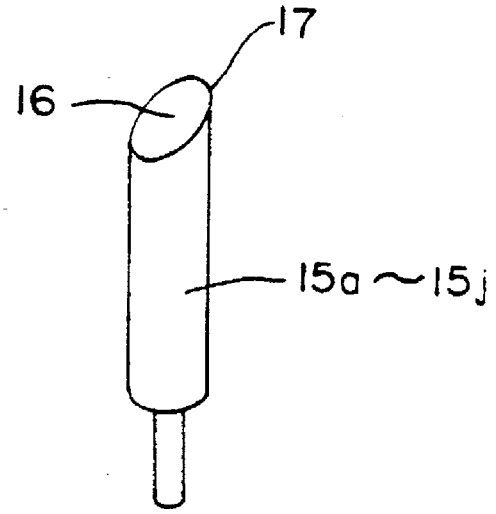
FIG. 34 is a perspective view of a cylindrical displacement member used in the wire rearranging apparatus of FIG. 32.

Referring to FIGS. 32 to 34, a fourth embodiment of a wire-interval changing apparatus according to the present invention is indicated generally at 400. The wire-interval changing apparatus 400 uses cylindrical blades 15*a–i* in place of the rectangular-sectioned blades used in the first embodiment 100. As best shown in FIG. 34, each cylindrical blade has a tapered end 17, and its tapered end 17 is aligned with the boundary line 21 of adjacent pipes 4. The chamfer 16 of the tapered end 17 functions like a wedge to separate adjacent pipes a distance equal to the diameter of the blades 15.

The springs 12*a*, 12*b* which maintain the pipes close together may be replaced by rubber or pneumatic cylinders. The wires are described as being inserted in the pipes after being rearranged, but the wires may be inserted in the pipes before rearranged.

The blade is described as having a width H equal to the outer diameter W of the pipe. It, however, should be understood that the width of the blade can be determined in consideration of the intervals at which selected wires are arranged, the positions at which such blades are placed between the forward and backward walls of the wire-interval changer, and other factors. In any event, it suffices that selected pipes are caused to diverge from each other with their forward ends separated appropriate distances for permitting the wires to be arranged at desired intervals when they exit from the forward ends of the pipes. In instances where the blades have a square cross-section, such as illustrated in the first embodiment and where the blades are positioned closest to the forward end wall 2 of the wire-interval changing apparatus the blade width is determined to be somewhat smaller than the outer diameter of the pipe for the following reason. One of two selected pipes is somewhat inclined to the intervening blade, and therefore, the two selected adjacent pipes are liable to be separated a distance equal to a diagonal of, rather than the side of the square. In contrast, where the blades are positioned apart from the forward wall of the wire-interval changing apparatus, the blade width is smaller than the outer diameter of the pipe, decreasing inversely with the increase of the distance from the forward wall of the wire-interval changer. If occasions demand, the blade width and/or blade position may be determined so as to permit selected wires to be separated by an integer multiple distance of the initial wire-interval at the outlet of the wire-interval changer.

In case that a wire-interval correction unit 23 having a comb 24 is used in correcting selected wires to exact intervals as requested, it is necessary to determine the blade width and/or position so as to permit selected wires to be deviated within the permissible range of each divergent slot of the comb plate 24, thereby allowing the teeth of the comb plate 24 to catch the deviated wires at the outlet of the wire-interval changing apparatus.

The pneumatic cylinders for driving the blades or the stepping motor 39 for driving the splined shaft 34 having the blades fixed thereto may be controlled according to an appropriate computer program or manually for instance, by selecting switches among a group of switches connecting between associated blade drivers and the power supply and by turning the so selected switches on according to an appropriate schedule.

As may be understood from the above, the wire-interval changer according to the present invention facilitates the quick changing of wire-arrangement patterns.

It will be appreciated that the embodiments of the present invention which have been discussed are merely illustrative of some of the applications of this invention and that numerous modifications may be made by those skilled in the art without departing from the true spirit and scope of this invention.

I claim:

1. An apparatus for changing the positioning of selective wires within a plurality of wires, comprising:

a base;

a plurality of elongated wire-receiving carriers movably supported on the base, one of said plurality of wires passing through each carrier;

biasing means for biasing the wire-receiving carriers into a first arrangement upon said base, wherein all of said wire-receiving carriers are generally parallel with respect to each other; and, a wire-receiving carrier shifting assembly for moving said wire-receiving carriers into and out of their first, parallel arrangement, the carrier shifting assembly including at least one shifter member which is selectively moveable actuatable between two operative positions, said shifter member being spaced from said wire-receiving carriers at said first position, and said shifter member contacting at least one of said wire-receiving carriers at said second position, said shifter member being aligned with said wire-receiving carriers such that when said shifter member occupies said second position, it moves between at least two adjacent wire-receiving carriers, thereby causing said adjacent wire-receiving carriers to spread transversely apart with respect to each other against said biasing means to thereby shift said wire-receiving carriers out of said first, parallel, arrangement into a second arrangement wherein said wire-receiving carriers are no longer parallel.

2. The apparatus as defined in claim 1, wherein said biasing means includes a pair of spring members disposed between said wire-receiving carriers and two opposing side surfaces of said apparatus.

3. The apparatus as defined in claim 1, wherein said shifter member includes at least one angled contact surface disposed in opposition to said wire-receiving carriers, said wire-receiving carrier shifting assembly further including pneumatic means for selectively moving said shifter member between said two positions.

4. The apparatus as defined in claim 1, wherein said shifting assembly includes two spaced-apart shifter members operatively connected to an actuating means for moving said shifter members between said two positions.

5. The apparatus as defined in claim 1 further including a cam detachably fixed to a shaft at a selected axial position thereof, the cam having first and second cam means thereon corresponding to raised and lower portions thereof.

6. The apparatus as defined in claim 1, wherein said shifter member includes a cylindrical rod member having a tapered surface in opposition to said wire-receiving carriers.

7. The apparatus as defined in claim 1, wherein said base includes opposing front and rear end portions and said wire-receiving carriers having front and rear portions and wire-receiving passageways extending between said front and rear portions, the base rear end portion fixedly supporting said wire-receiving carriers at said rear end portions and restraining said wire-receiving carrier rear end portions from any substantial transverse shifting movement, the base front end portion slidingly supporting said wire-receiving carriers at said front end portions and permitting said wire-receiving carrier front end portions to shift transversely within said base front end portion.

8. The apparatus as defined in claim 7, wherein said wire-receiving carriers include hollow, tubular members.

9. The apparatus as defined in claim 7, wherein said assembly includes a plurality of shifter members, each of said shifter members including at least one angled contact surface, said shifter member contact surfaces having different heights relative to each other, whereby one of said shifter members contacts said wire-receiving carriers first, while at least another of said shifter members contacts said wire-receiving carriers secondly, thereby effecting sequential first and second lateral movements of said wire-receiving carriers at said front end portions thereof.

10. The apparatus as defined in claim 7, wherein said shifting assembly further includes a slotted wire comb selectively actuatable into and out of horizontal alignment with said wire-receiving carrier front ends, the comb having a plurality of slots disposed therein which receive wires fed through said wire-receiving carriers.

11. The apparatus as defined in claim 7, wherein said shifter member includes a cam wheel disposed proximate to said base front end portion and proximate to said wire-receiving carriers, the cam wheel being rotatably mounted to a shaft and further being rotatably operable between said first and second positions, said cam wheel having at least one cam surface which moves between said wire carriers in said second position.

12. An apparatus for changing the interval of selected wires within an arrangement of a plurality of wires wherein the wires are generally parallel, the apparatus comprising: a base member, the base member having opposing first and second ends, said base member further having two opposing side blocks disposed between said first and second ends, said first end, second end and two side blocks cooperating to define a wire-receiving area of said apparatus; a plurality of elongated wire carriers disposed within said wire-receiving area and extending between said base member first and second ends, each wire carrier having a passageway extending axially therethrough, each wire carrier further including opposing first and second openings respectively disposed opposite said base first and second ends, said base first end fixedly receiving said wire carriers at said first opening thereof in a manner so as to restrict said wire carrier first ends from any substantial lateral movement, said base member second end slidably receiving said wire carriers at said second openings thereof so as to permit said wire carrier second ends to move laterally near their second openings when a force is applied to said wire carriers; means for biasing said wire carriers into a first predetermined spacing wherein said wire carriers are substantially parallel to each other along their respective lengths; and, means for changing the spacing interval of said wire carriers including means for applying a sufficient force to said wire carriers proximate to said base member second end to overcome said wire carrier biasing means to thereby cause selected wire carriers to spread laterally apart from each other proximate to said base member second end, thereby changing the interval of said wires in said arrangement.

13. The wire interval changing apparatus as defined in claim 12, wherein said wire carriers include a plurality of elongated, hollow, tubes.

14. The wire internal changing apparatus as defined in claim 12, wherein said wire carrier biasing means include a pair of springs interposed between said wire carriers and said side blocks.

15. The wire interval changing apparatus as defined in claim 12, wherein said base member second end includes a slot extending laterally within said base member second end, said wire carrier being slidingly received within said slot proximate to said second openings thereof, said slot including at least one expansion space disposed between a wall of said base member second end and said wire carriers, said expansion space defining an open area into which some of said wire carriers may be displaced upon actuation of said wire carrier displacement means.

16. The wire interval changing apparatus as claimed in claim 12, wherein said interval changing means includes an elongated vertical displacement member moveable between a first and second operating positions and disposed in alignment with a line of engagement lying between a pair of adjacent wire carriers, the displacement member having an angled contact surface which contacts at least one of said pair of adjacent wire carriers when said displacement member is in said second operating position, said displacement member exerting, by way of said contact surface, a lateral displacement force on said one wire carrier to thereby laterally change said parallel arrangement of said wire carriers proximate to said base member second end.

17. The wire interval changing apparatus as defined in claim 16, wherein said interval changing means includes a plurality of displacement members.

18. The wire interval changing apparatus as defined in claim 17, wherein each of said displacement members is independently actuatable between said first and second operating positions.

19. The wire interval changing apparatus as defined in claim 17, wherein said displacement members are operatively connected to a mounting bar, whereby all of said displacement members act in unison as said displacement members move between said first and second operating positions.

20. The wire interval changing apparatus as defined in claim 12, wherein said interval changing means includes at least one displacement member mounted to a shaft in proximity to said wire carriers, the displacement member being rotatable between first and second operating positions, said rotatable displacement member further including a cam surface which contacts at least one of said pair of adjacent wire carriers when said displacement member is in said first operating position.

21. The wire interval changing apparatus as defined in claim 20, wherein said displacement member includes a cam wheel and said cam surface includes an angled contact surface.

* * * * *